US008424607B2

(12) United States Patent
Springett et al.

(10) Patent No.: US 8,424,607 B2
(45) Date of Patent: Apr. 23, 2013

(54) SYSTEM AND METHOD FOR SEVERING A TUBULAR

(75) Inventors: Frank Benjamin Springett, Spring, TX (US); Christopher Dale Johnson, Cypress, TX (US); Shern Eugene Peters, Houston, TX (US); Eric Trevor Ensley, Cypress, TX (US); James Brugman, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 13/118,200

(22) Filed: May 27, 2011

(65) Prior Publication Data

US 2011/0226475 A1 Sep. 22, 2011

Related U.S. Application Data

(60) Continuation-in-part of application No. 12/883,469, filed on Sep. 16, 2010, now Pat. No. 8,066,070, which is a continuation of application No. 12/151,279, filed on May 5, 2008, now Pat. No. 7,814,979, and a division of application No. 11/411,203, filed on Apr. 25, 2006, now Pat. No. 7,367, 396.

(60) Provisional application No. 61/349,660, filed on May 28, 2010, provisional application No. 61/349,604, filed on May 28, 2010, provisional application No. 61/359,746, filed on Jun. 29, 2010, provisional application No. 61/373,734, filed on Aug. 13, 2010.

(51) Int. Cl.
*E21B 29/00* (2006.01)

(52) U.S. Cl.
USPC ..... 166/298; 166/361; 166/368; 166/55; 83/54

(58) Field of Classification Search ..... 166/55.2, 166/55.3, 55.6, 351, 383, 84.3, 85.4, 387, 166/84.4, 379, 298, 361, 363, 364, 368; 251/1.1, 251/1.2; 30/92–97; 83/51, 54, 660, 842, 83/846, 849; 225/29, 54, 92
See application file for complete search history.

(56) References Cited

U.S. PATENT DOCUMENTS 1,161,705 A 11/1915 Lloyd et al.
1,981,059 A * 11/1934 Matthews et al. ..... 156/251
(Continued)

FOREIGN PATENT DOCUMENTS

CA 2649771 11/2007
DE 35 16424 A1 11/1986
(Continued)

OTHER PUBLICATIONS

Casselman et al., "Device's Design Flaw Let Oil Spill Freely," Business, Mar. 24, 2011, pp. 1-4.
(Continued)

*Primary Examiner* — Matthew Buck
(74) *Attorney, Agent, or Firm* — The JL Salazar Law Firm

(57) ABSTRACT

The invention relates to techniques for severing a tubular. A blowout preventer is provided with a housing having a bore therethrough for receiving the tubular, an actuator positionable in the housing, and a plurality of cutting tools positionable in the housing and selectively movable into an actuated position with the actuator. Each of the cutting tools have a base supportable by the actuator and selectively movable thereby, and a cutting head supported by the base. The cutting head comprising a tip having a piecing point at an end thereof and at least one cutting surface. The piercing point pierces the tubular and the cutting surfaces taper away from the piercing point for cutting through the tubular whereby the cutting head passes through tubular.

28 Claims, 12 Drawing Sheets

U.S. PATENT DOCUMENTS

| | | | | | |
|---|---|---|---|---|---|
| 2,178,698 | A | | 11/1939 | Penick et al. | |
| 2,231,613 | A | | 2/1941 | Burke | |
| 2,304,793 | A | | 12/1942 | Bodine, Jr. | |
| 2,504,377 | A | * | 4/1950 | Beil | 251/1.1 |
| 2,555,069 | A | | 5/1951 | Verney | |
| 2,592,197 | A | | 4/1952 | Schweitzer | |
| 2,596,851 | A | | 5/1952 | Hansen | |
| 2,717,440 | A | * | 9/1955 | Anacker | 30/95 |
| 2,752,119 | A | | 6/1956 | Allen et al. | |
| 2,825,130 | A | * | 3/1958 | Fry | 30/92 |
| 2,851,773 | A | * | 9/1958 | Jennison | 225/94 |
| 2,919,111 | A | | 12/1959 | Nicholson | |
| 3,040,611 | A | | 6/1962 | Tournaire | |
| 3,145,462 | A | | 8/1964 | Bognar | |
| 3,190,330 | A | * | 6/1965 | Hawkins | 30/176 |
| 3,272,222 | A | | 9/1966 | Allen et al. | |
| 3,323,773 | A | * | 6/1967 | Walker | 251/1.2 |
| 3,399,728 | A | | 9/1968 | Allan | |
| 3,449,993 | A | * | 6/1969 | Temple | 83/623 |
| 3,554,278 | A | | 1/1971 | Reistle, III et al. | |
| 3,554,480 | A | | 1/1971 | Rowe | |
| 3,561,526 | A | | 2/1971 | Williams, Jr. et al. | |
| 3,561,723 | A | * | 2/1971 | Cugini | 251/1.2 |
| 3,566,724 | A | * | 3/1971 | Templeton et al. | 83/861 |
| 3,647,174 | A | | 3/1972 | LeRouax | |
| 3,667,721 | A | * | 6/1972 | Vujasinovic | 251/1.1 |
| 3,670,761 | A | | 6/1972 | Lerouax | |
| 3,716,068 | A | | 2/1973 | Addison | |
| 3,741,296 | A | | 6/1973 | Murman et al. | |
| 3,744,749 | A | | 7/1973 | Le Rouax | |
| 3,756,108 | A | * | 9/1973 | Fuchs, Jr. | 83/193 |
| 3,766,979 | A | | 10/1973 | Petrick | |
| 3,863,667 | A | | 2/1975 | Ward | |
| 3,918,478 | A | | 11/1975 | Le Rouax | |
| 3,922,780 | A | | 12/1975 | Green | |
| 3,946,806 | A | | 3/1976 | Meynier, III | |
| 3,955,622 | A | | 5/1976 | Jones | |
| 4,007,797 | A | | 2/1977 | Jeter | |
| 4,015,496 | A | | 4/1977 | Hill | |
| 4,043,389 | A | | 8/1977 | Cobb | |
| 4,057,887 | A | | 11/1977 | Jones et al. | |
| 4,068,711 | A | * | 1/1978 | Aulenbacher | 166/55.3 |
| 4,119,115 | A | | 10/1978 | Carruthers | |
| 4,132,265 | A | | 1/1979 | Williams, Jr. | |
| 4,132,267 | A | | 1/1979 | Jones | |
| 4,140,041 | A | | 2/1979 | Frelau | |
| 4,215,749 | A | | 8/1980 | Dare et al. | |
| 4,220,206 | A | | 9/1980 | Van Winkle | |
| 4,253,638 | A | | 3/1981 | Troxell, Jr. | |
| 4,313,496 | A | | 2/1982 | Childs et al. | |
| 4,341,264 | A | | 7/1982 | Cox et al. | |
| 4,347,898 | A | | 9/1982 | Jones | |
| 4,372,527 | A | | 2/1983 | Rosenhauch et al. | |
| 4,392,633 | A | | 7/1983 | Van Winkle | |
| 4,416,441 | A | | 11/1983 | Van Winkle | |
| 4,437,643 | A | | 3/1984 | Brakhage, Jr. et al. | |
| 4,492,359 | A | | 1/1985 | Baugh | |
| 4,504,037 | A | | 3/1985 | Beam et al. | |
| 4,508,313 | A | | 4/1985 | Jones | |
| 4,516,598 | A | | 5/1985 | Stupak | |
| 4,518,144 | A | | 5/1985 | Vicic et al. | |
| 4,519,577 | A | | 5/1985 | Jones | |
| 4,523,639 | A | | 6/1985 | Howard, Jr. | |
| 4,526,339 | A | | 7/1985 | Miller | |
| 4,537,250 | A | * | 8/1985 | Troxell, Jr. | 166/55 |
| 4,540,046 | A | | 9/1985 | Granger et al. | |
| 4,549,349 | A | | 10/1985 | Harrison | |
| 4,550,895 | A | | 11/1985 | Shaffer | |
| 4,558,842 | A | | 12/1985 | Peil et al. | |
| 4,612,983 | A | | 9/1986 | Karr, Jr. | |
| 4,646,825 | A | | 3/1987 | Van Winkle | |
| 4,647,002 | A | | 3/1987 | Crutchfield | |
| 4,690,033 | A | | 9/1987 | Van Winkle | |
| 4,690,411 | A | | 9/1987 | Van Winkle | |
| 4,699,350 | A | | 10/1987 | Herve | |
| 4,858,882 | A | * | 8/1989 | Beard et al. | 251/1.2 |
| 4,923,005 | A | | 5/1990 | Laky et al. | |
| 4,923,008 | A | | 5/1990 | Wachowicz et al. | |
| 4,943,031 | A | | 7/1990 | Van Winkle | |
| 4,949,785 | A | * | 8/1990 | Beard et al. | 166/84.4 |
| 4,969,390 | A | | 11/1990 | Williams, III | |
| 4,987,956 | A | | 1/1991 | Hansen et al. | |
| 5,002,130 | A | | 3/1991 | Laky | |
| 5,013,005 | A | | 5/1991 | Nance | |
| 5,025,708 | A | | 6/1991 | Smith et al. | |
| 5,056,418 | A | | 10/1991 | Granger et al. | |
| 5,116,017 | A | * | 5/1992 | Granger et al. | 251/1.2 |
| 5,178,215 | A | | 1/1993 | Yenulis et al. | |
| 5,199,493 | A | | 4/1993 | Sodder, Jr. | |
| 5,217,073 | A | | 6/1993 | Bruns | |
| 5,237,899 | A | | 8/1993 | Schartinger | |
| 5,360,061 | A | | 11/1994 | Womble | |
| 5,361,832 | A | | 11/1994 | Van Winkle | |
| 5,400,857 | A | | 3/1995 | Whitby et al. | |
| 5,505,426 | A | | 4/1996 | Whitby et al. | |
| 5,515,916 | A | | 5/1996 | Haley | |
| 5,566,753 | A | | 10/1996 | Van Winkle et al. | |
| 5,575,451 | A | | 11/1996 | Colvin et al. | |
| 5,575,452 | A | | 11/1996 | Whitby et al. | |
| 5,588,491 | A | * | 12/1996 | Brugman et al. | 166/383 |
| 5,590,867 | A | | 1/1997 | Van Winkle | |
| 5,655,745 | A | | 8/1997 | Morrill | |
| 5,662,171 | A | * | 9/1997 | Brugman et al. | 166/383 |
| 5,713,581 | A | | 2/1998 | Carlson et al. | |
| 5,735,502 | A | | 4/1998 | Levett et al. | |
| 5,778,918 | A | | 7/1998 | McLelland | |
| 5,863,022 | A | | 1/1999 | Van Winkle | |
| 5,897,094 | A | | 4/1999 | Brugman et al. | |
| 5,918,851 | A | | 7/1999 | Whitby | |
| 5,961,094 | A | | 10/1999 | Van Winkle | |
| 5,975,484 | A | | 11/1999 | Brugman et al. | |
| 6,006,647 | A | | 12/1999 | Van Winkle | |
| 6,012,528 | A | | 1/2000 | Van Winkle | |
| 6,016,880 | A | | 1/2000 | Hall et al. | |
| 6,113,061 | A | | 9/2000 | Van Winkle | |
| 6,158,505 | A | | 12/2000 | Araujo | |
| 6,164,619 | A | | 12/2000 | Van Winkle et al. | |
| 6,173,770 | B1 | | 1/2001 | Morrill | |
| 6,192,680 | B1 | | 2/2001 | Brugman et al. | |
| 6,244,336 | B1 | | 6/2001 | Kachich | |
| 6,244,560 | B1 | | 6/2001 | Johnson | |
| 6,276,450 | B1 | | 8/2001 | Seneviraine | |
| 6,374,925 | B1 | | 4/2002 | Elkins et al. | |
| 6,484,808 | B2 | | 11/2002 | Jones et al. | |
| 6,510,897 | B2 | | 1/2003 | Hemphill | |
| 6,530,432 | B2 | | 3/2003 | Gipson | |
| 6,601,650 | B2 | | 8/2003 | Sundararajan | |
| 6,718,860 | B2 | | 4/2004 | Mitsukawa et al. | |
| 6,719,042 | B2 | | 4/2004 | Johnson et al. | |
| 6,742,597 | B2 | | 6/2004 | Van Winkle et al. | |
| 6,834,721 | B2 | | 12/2004 | Suro | |
| 6,843,463 | B1 | | 1/2005 | McWhorter et al. | |
| 6,857,634 | B2 | | 2/2005 | Araujo | |
| 6,964,303 | B2 | | 11/2005 | Mazorow et al. | |
| 6,969,042 | B2 | | 11/2005 | Gaydos | |
| 6,974,135 | B2 | | 12/2005 | Melancon et al. | |
| 7,011,159 | B2 | | 3/2006 | Holland | |
| 7,011,160 | B2 | | 3/2006 | Boyd | |
| 7,044,430 | B2 | | 5/2006 | Brugman et al. | |
| 7,051,989 | B2 | | 5/2006 | Springett et al. | |
| 7,051,990 | B2 | | 5/2006 | Springett et al. | |
| 7,055,594 | B1 | | 6/2006 | Springett et al. | |
| 7,086,467 | B2 | | 8/2006 | Schlegelmilch et al. | |
| 7,108,081 | B2 | | 9/2006 | Boyadjieff | |
| 7,165,619 | B2 | | 1/2007 | Fox et al. | |
| 7,181,808 | B1 | | 2/2007 | Van Winkle | |
| 7,195,224 | B2 | | 3/2007 | Le | |
| 7,207,382 | B2 | | 4/2007 | Schaeper | |
| 7,225,873 | B2 | | 6/2007 | Schlegelmilch et al. | |
| 7,234,530 | B2 | | 6/2007 | Gass | |
| 7,243,713 | B2 | | 7/2007 | Isaacks et al. | |
| 7,270,190 | B2 | | 9/2007 | McWhorter et al. | |
| 7,287,544 | B2 | | 10/2007 | Seneviratne et al. | |
| 7,331,562 | B2 | | 2/2008 | Springett | |
| 7,350,587 | B2 | | 4/2008 | Springett et al. | |
| 7,354,026 | B2 | | 4/2008 | Urrutia | |
| 7,360,603 | B2 | | 4/2008 | Springett et al. | |

| | | | | |
|---|---|---|---|---|
| 7,367,396 | B2 | 5/2008 | Springett et al. | |
| 7,389,817 | B2 | 6/2008 | Almdahl et al. | |
| 7,409,988 | B2 * | 8/2008 | Borden et al. | 166/84.1 |
| 7,410,003 | B2 | 8/2008 | Ravensbergen | |
| 7,434,369 | B2 | 10/2008 | Uneyama et al. | |
| 7,464,765 | B2 | 12/2008 | Isaacks et al. | |
| 7,487,848 | B2 | 2/2009 | Wells et al. | |
| 7,520,129 | B2 | 4/2009 | Springett | |
| 7,523,644 | B2 | 4/2009 | Van Winkle | |
| 7,673,674 | B2 | 3/2010 | Lam | |
| 7,703,739 | B2 | 4/2010 | Judge et al. | |
| 7,726,418 | B2 | 6/2010 | Ayling | |
| 7,748,473 | B2 | 7/2010 | Wells et al. | |
| 7,798,466 | B2 | 9/2010 | Springett et al. | |
| 7,814,979 | B2 | 10/2010 | Springett et al. | |
| 8,066,070 | B2 | 11/2011 | Springett et al. | |
| 2003/0127231 | A1 | 7/2003 | Schlegelmilch et al. | |
| 2004/0124380 | A1 | 7/2004 | Van Winkle | |
| 2005/0183856 | A1 * | 8/2005 | Williams | 166/84.3 |
| 2006/0076526 | A1 | 4/2006 | McWhorter et al. | |
| 2006/0113501 | A1 | 6/2006 | Isaacks et al. | |
| 2006/0137827 | A1 | 6/2006 | Uneyama et al. | |
| 2007/0102655 | A1 | 5/2007 | Springett | |
| 2007/0137866 | A1 | 6/2007 | Ravensbergen et al. | |
| 2007/0240874 | A1 * | 10/2007 | Williams | 166/84.3 |
| 2007/0246215 | A1 | 10/2007 | Springett et al. | |
| 2008/0040070 | A1 | 2/2008 | McClanahan | |
| 2008/0185046 | A1 | 8/2008 | Springett et al. | |
| 2008/0189954 | A1 | 8/2008 | Lin | |
| 2008/0265188 | A1 | 10/2008 | Springett et al. | |
| 2008/0267786 | A1 | 10/2008 | Springett et al. | |
| 2008/0286534 | A1 | 11/2008 | Springett et al. | |
| 2009/0056132 | A1 | 3/2009 | Foote | |
| 2009/0205838 | A1 | 8/2009 | Springett | |
| 2010/0038088 | A1 | 2/2010 | Springett et al. | |
| 2012/0193087 | A1 | 8/2012 | Hall et al. | |
| 2012/0193556 | A1 | 8/2012 | Yadav et al. | |

FOREIGN PATENT DOCUMENTS

| | | | |
|---|---|---|---|
| EP | 0 145 456 | A2 | 6/1985 |
| EP | 0593280 | | 4/1994 |
| EP | 2013443 | | 6/2011 |
| GB | 2 100 773 | A | 1/1983 |
| JP | S53-015683 | A | 2/1978 |
| RU | 2401935 | | 5/2010 |
| SU | 959935 | A | 9/1982 |
| WO | 99/49179 | A1 | 9/1999 |
| WO | 03/060288 | A1 | 7/2003 |
| WO | 2005/106187 | A1 | 11/2005 |
| WO | 2006014895 | A2 | 2/2006 |
| WO | 2007/122365 | A1 | 11/2007 |

OTHER PUBLICATIONS

CIPO, Canadian Patent Application No. 2,649,771, Examination Report and Response, May 28, 2010, pp. 1-17.

EPO, European Patent Application No. 11168306.6, Extended European Search Report, Aug. 4, 2011, pp. 1-6.

EPO, European Patent Application No. 06820703.4, First Examination Report and Response, Sep. 11, 2009, 47 pgs.

EPO, European Patent Application No. 06820703.4, Notice of Allowance and Post Allowance Amendment, Aug. 3, 2010, 39 pgs.

EPO, European Patent Application No. 06820703.4, Post Allowance Amendment including French and German language translations and amended claims, Dec. 13, 2010, 49 pgs.

EPO, PCT Patent Application No. PCT/GB2006/050478, Demand, Written Opinion Response and Amended Claims, Feb. 25, 2008, 32 pgs.

EPO, PCT Patent Application No. PCT/GB2006/050478, International Preliminary Report on Patentability, Aug. 12, 2008, 8 pgs.

EPO, PCT Patent Application No. PCT/GB2006/050478, International Search Report and Written Opinion, Apr. 4, 2007, 11 pgs.

Lukosavich, "OTC 2011 Shifts Gears to Navigate Post-Macondo Landscape," Word Oil, vol. 232, No. 4, pp. 1-8.

National Oilwell Varco, "National Oilwell Varco Makes Spotlight Award List," Offshore Magazine, Apr. 2011, pp. 1.

National Oilwell Varco, OTC 2011: ShearMax Low Force Casing Shear Rams, p. 1.

RU, Russian Patent Application No. 2008146406, Russian Amended Claim Set and Decision on Grant, May 12, 2010, 17 pgs.

Shear Ram Capabilities Study: West Engineering Services, Sep. 2004, pp. Cover to 4-7 (23 pgs.).

Springett et al., "Low Force Shear Rams: The Future is More," SPE/IADC 140365, Mar. 1-3, 2011, pp. 1-9.

Varco's NXT Next Generation BOP Systems reduce the cost of Drilling: Varco, 2001, 6 pgs.

Langely, , "Drilling Contractor", Categorized, Jan. 28, 2011, p. 5.

Land and Marine Drilling; Cameron Iron Works Oil Tool Division; pp. Cover, 1604, 1617, 1621: 1982-1983.

EPO Extended Search Report for counterpart Application No. 11180788.9, Dec. 6, 2011, 8 pages.

EPO Extended Search Report for counterpart Application No. 11180811.9, May 30, 2012, 6 pages.

PCT Notification of Transmittal of International Search Report and the Written Opinion for counterpart application PCT/GB2011/051006, Nov. 28, 2011, 12 pages.

PCT Notification of Transmittal of International Search Report and the Written Opinion for counterpart application PCT/GB2011/051005, Nov. 28, 2011, 11 pages.

PCT Notification of Transmittal of International Search Report and the Written Opinion for counterpart application PCT/GB2011/051004, Nov. 30, 2011, 12 pages.

PRC Office Action for Chinese Application No. 200680054363.7, Aug. 25, 2011, 5 pages.

PRC Office Action for Chinese Application No. 200680054363.7, Apr. 1, 2012, 4 pages.

Response to Office Action of Apr. 1, 2012 in counterpart Chinese Application No. 200680054363.7, 12 pages.

Response to Office Action of Aug. 25, 2011 in counterpart Chinese Application No. 200680054363.7, 7 pages.

CIPO, Canadian Patent Application 2649771, Notice of Allowance, Jan. 26, 2011, 1 page.

CIPO, Canadian Patent Application 2754716, Notice of Allowance, Dec. 22, 2011, 6 pages.

CIPO, Canadian Patent Application 2747138, Examination Report, Oct. 25, 2011, 2 pages.

Canadian Patent Application 2747138, Response to Examination Report, Apr. 19, 2012, 9 pages.

CIPO, Canadian Patent Application 2747138, Notice of Allowance, May 23, 2012, 1 page.

* cited by examiner

SYSTEM AND METHOD FOR SEVERING A TUBULAR

CROSS-REFERENCE TO RELATED APPLICATIONS

This application is a continuation-in-part of U.S. Non-Provisional Application No. 12/883,469 filed on Sep. 16, 2010, which is a continuation of U.S. Non-Provisional Application No. 12/151,279 filed on May 5, 2008, which is now U.S. Pat. No. 7,814,979, which is a divisional of U.S. Non-Provisional Application No. 11/411,203 filed on Apr. 25, 2006, which is now U.S. Pat. No. 7,367,396, the entire contents of which are hereby incorporated by reference. This application also claims the benefit of U.S. Provisional Application No. 61/349,660 on May 28, 2010, U.S. Provisional Application No. 61/349,604 filed on May 28, 2010, U.S. Provisional Application No. 61/359,746 filed on Jun. 29, 2010, and U.S. Provisional Application No. 61/373,734 filed on Aug. 13, 2010, the entire contents of which are hereby incorporated by reference.

BACKGROUND OF THE INVENTION

1. Field of the Invention

This present invention relates generally to techniques for performing wellsite operations. More specifically, the present invention relates to techniques for preventing blowouts, for example, involving severing a tubular at the wellsite.

2. Description of Related Art

Oilfield operations are typically performed to locate and gather valuable downhole fluids. Oil rigs are positioned at wellsites, and downhole tools, such as drilling tools, are deployed into the ground to reach subsurface reservoirs. Once the downhole tools form a wellbore (or borehole) to reach a desired reservoir, casings may be cemented into place within the wellbore, and the wellbore completed to initiate production of fluids from the reservoir. Tubulars (or tubular strings) may be positioned in the wellbore to enable the passage of subsurface fluids to the surface.

Leakage of subsurface fluids may pose an environmental threat if released from the wellbore. Equipment, such as blow out preventers (BOPs), are often positioned about the wellbore to form a seal about a tubular therein to prevent leakage of fluid as it is brought to the surface. Typical BOPs may have selectively actuatable rams or ram bonnets, such as pipe rams (to contact, engage, and encompass tubulars and/or tools to seal a wellbore) or shear rams (to contact and physically shear a tubular), that may be activated to sever and/or seal a tubular in a wellbore. Some examples of BOPs and/or ram blocks are provided in U.S. patent application Ser. Nos. 4,647,002, 6,173,770, 5,025,708, 5,575,452, 5,655,745, 5,918,851, 4,550,895, 5,575,451, 3,554,278, 5,505,426, 5,013,005, 5,056,418, 7,051,989, 5,575,452, 2008/0265188, 5,735,502, 5,897,094, 7,234,530 and 2009/0056132. Additional examples of BOPs, shear rams, and/or blades for cutting tubulars are disclosed in U.S. Pat. Nos. 3,946,806, 4,043,389, 4,313,496, 4,132,267, 4,558,842, 4,969,390, 4,492,359, 4,504,037, 2,752,119, 3,272,222, 3,744,749, 4,253,638, 4,523,639, 5,025,708, 5,400,857, 4,313,496, 5,360,061, 4,923,005, 4,537,250, 5,515,916, 6,173,770, 3,863,667, 6,158,505, 4,057,887, 5,178,215, and 6,016,880. Some BOPs may be spherical (or rotating or rotary) BOPs as described, for example, in U.S. Pat. Nos. 5,588,491 and 5,662,171, the entire contents of which are hereby incorporated by reference herein.

Despite the development of techniques for addressing blowouts, there remains a need to provide advanced techniques for more effectively severing a tubular within a BOP. The invention herein is directed to fulfilling this need in the art.

SUMMARY OF THE INVENTION

The invention relates to a cutting tool for severing a tubular of a wellbore. The cutting tool is positionable in a housing and actuatable by an actuator of a blowout preventer. The blowout preventer has a bore therethrough for receiving the tubular. The cutting tool has a base supportable by the actuator and selectively movable thereby, and a cutting head supported by the base. The cutting head has a tip with a piercing point at an end thereof and at least one cutting surface. The piercing point is for piercing the tubular. The cutting surface tapers away from the piercing point for cutting through the tubular whereby the cutting head passes through tubular.

The tip may be removeable. The tip may have a connector receivable by a hole in the cutting head. The tip may also be frangible, or terminate at a leading edge or at a point. The cutting surface may have a plurality of flat surfaces, each of the plurality of flat surfaces extending at an angle from the tip.

The cutting tool may be made of a hardening material. The cutting head may have a guide surface for slidably engaging a guide of the housing. The cutting tool may also have a body between the base and the cutting head.

In another aspect, the invention may relate to a blowout preventer for severing a tubular of a wellbore. The blowout preventer may have a housing having a bore therethrough for receiving the tubular, an actuator positionable in the housing, and a plurality of cutting tools positionable in the housing and selectively movable into an actuated position with the actuator. Each of the cutting tools may have a base supportable by the actuator and selectively movable thereby, and a cutting head supported by the base. The cutting head has a tip with a piercing point at an end thereof and at least one cutting surface. The piercing point is for piercing the tubular. The cutting surface tapers away from the piercing point for cutting through the tubular whereby the cutting head passes through tubular.

The housing may have an insert therein defining a guide, and the cutting head may have a guide surface for slidably engaging the guide. The actuator may have a piston having a piston head for engaging an actuation surface of the base. The blowout preventer may also have at least one elastomeric element positionable between the cutting tools, a cutting tool carrier for supporting the cutting tools, and a seal for sealing the bore. The cutting tools may be arranged in a dome-shaped or inverted dome-shaped configuration with the tips of each of the cutting tools converging about the tubular.

In yet another aspect, the invention may relate to a method of severing a tubular of a wellbore. The method involves positioning a BOP about the tubular (the BOP comprising a housing and an actuator), and positioning a plurality of cutting tools in the housing. Each cutting tool has a base supportable by the actuator and selectively movable thereby, and a cutting head supported by the base. The cutting head has a tip with a piercing point at an end thereof and at least one cutting surface. The piercing point is for piercing the tubular. The cutting surface tapers away from the piercing point. The method may further involve selectively moving the cutting tools to an actuated position with the actuator such that the cutting head passes through the tubular by piercing the tubular with the tip of the cutting head and cutting through the tubular with the cutting surface of the cutting head.

The method may also involve guiding the plurality of cutting tools along a guide of the housing, sealing a bore of the housing with a seal, breaking off a portion of the cutting head, replacing a portion of the cutting head, selectively retracting the plurality of cutting tools, and/or securing the plurality of cutting tools with the cutting tool carrier.

BRIEF DESCRIPTION OF DRAWINGS

So that the above recited features and advantages of the invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The Figures are not necessarily to scale, and certain features and certain views of the Figures may be shown exaggerated in scale or in schematic in the interest of clarity and conciseness.

FIG. 4A shows the portion of the tubular severing system without a tubular. FIG. 4B shows the portion of the tubular severing system with a tubular.

DETAILED DESCRIPTION OF THE INVENTION

The description that follows includes exemplary apparatus, methods, techniques, and instruction sequences that embody techniques of the inventive subject matter. However, it is understood that the described embodiments may be practiced without these specific details.

This application relates to a BOP and tubular severing system used to sever a tubular at a wellsite. The tubular may be, for example, a tubular that is run through the BOP during wellsite operations and/or other downhole tubular devices, such as pipes, certain downhole tools, casings, drill pipe, liner, coiled tubing, production tubing, wireline, slickline, or other tubular members positioned in the wellbore and associated components, such as drill collars, tool joints, drill bits, logging tools, packers, and the like, (referred to as 'tubulars' or 'tubular strings'). The severing operation may allow the tubular to be removed from the BOP and/or the wellhead. Severing the tubular may be performed, for example, in order to seal off a borehole in the event the borehole has experienced a leak, and/or a blow out. The BOP and tubular severing system may be provided with various configurations for facilitating severance of the tubular. These configurations are provided with cutting tools intended to reduce the force required to sever a tubular. The invention provides techniques for severing a variety of tubulars (or tubular strings), such as those having a diameter of up to about 8.5 inches (21.59 cm) or more. Preferably, the BOP and severing system provide one or more of the following, among others: efficient part (e.g., the severing system) replacement, reduced wear, less force required to sever tubular, automatic sealing of the BOP, efficient severing, incorporation into (or use with) existing equipment and less maintenance time for part replacement.

Figure 1:
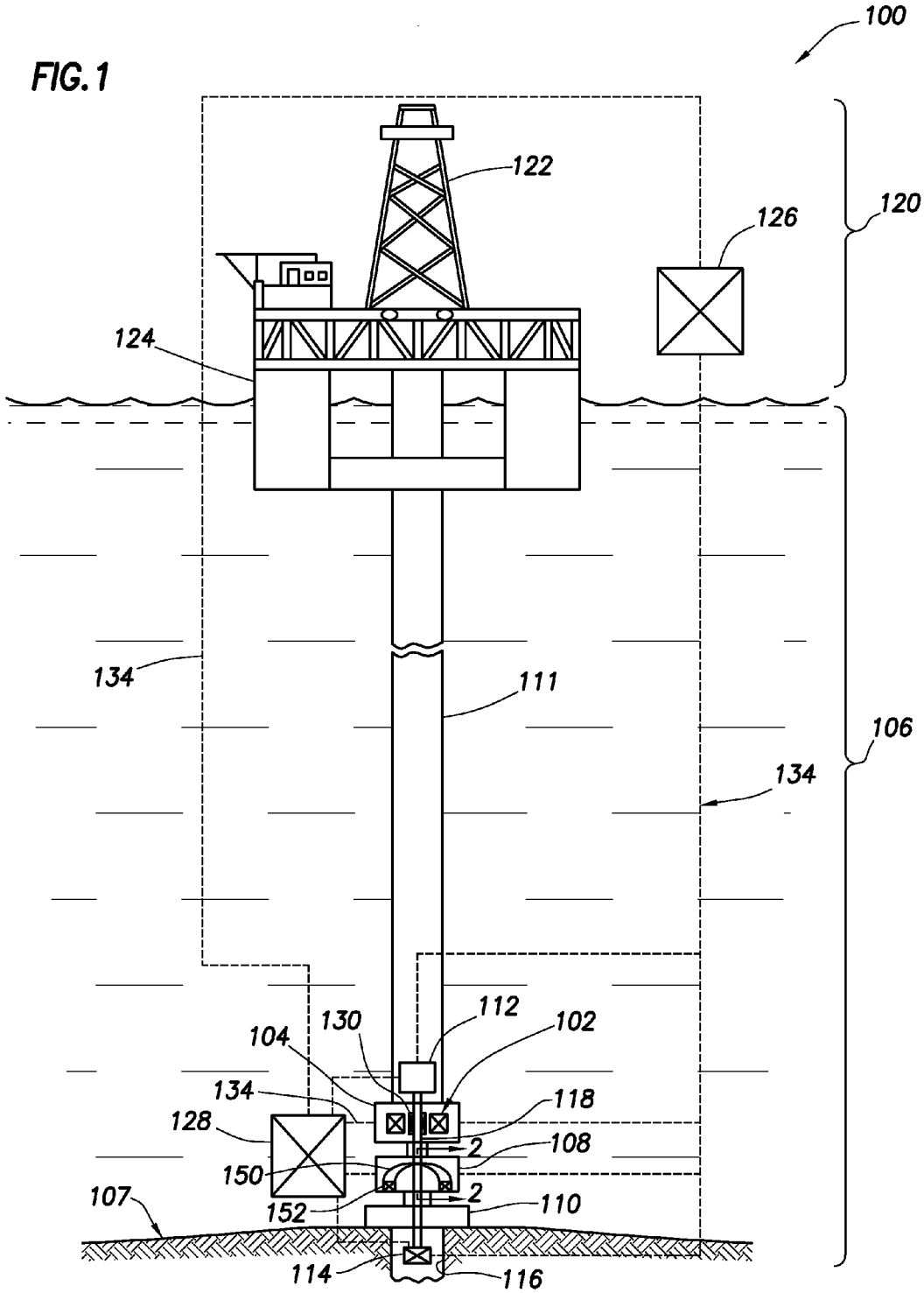
FIG. 1 is a schematic view of an offshore wellsite having a blowout preventer (BOP) with a tubular severing system.

FIG. 1 depicts an offshore wellsite 100 having a subsea system 106 and a surface system 120. The subsea system 106 has a stripper 102, a BOP 108 a wellhead 110, and a tubing delivery system 112. The stripper 102 and/or the BOP 108 may be configured to seal a tubular string 118 (and/or conveyance), and run into a wellbore 116 in the sea floor 107. The BOP 108 has a tubular severing system 150 for severing the tubular string 118, a downhole tool 114, and/or a tool joint (or other tubular not shown). The BOP 108 may have one or more actuators 152 for actuating the tubular severing system 150 thereby severing the tubular string 118. One or more controllers 126 and/or 128 may operate, monitor and/or control the BOP 108, the stripper 102, the tubing delivery system 112 and/or other portions of the wellsite 100.

The tubing delivery system 112 may be configured to convey one or more downhole tools 114 into the wellbore 116 on the tubular string 118. Although the BOP 108 is described as being used in subsea operations, it will be appreciated that the wellsite 100 may be land or water based and the BOP 108 may be used in any wellsite environment.

The surface system 120 may be used to facilitate the oilfield operations at the offshore wellsite 100. The surface system 120 may comprise a rig 122, a platform 124 (or vessel) and the controller 126. As shown the controller 126 is at a surface location and the subsea controller 128 is in a subsea location, it will be appreciated that the one or more controllers 126/128 may be located at various locations to control the surface 120 and/or the subsea systems 106. Communication links 134 may be provided by the controllers 126/128 for communication with various parts of the wellsite 100.

As shown, the tubing delivery system 112 may be located within a conduit 111, although it should be appreciated that it may be located at any suitable location, such as at the sea surface, proximate the subsea equipment 106, without the conduit 111, within the rig 122, and the like. The tubing delivery system 112 may be any tubular delivery system such as a coiled tubing injector, a drilling rig having equipment such as a top drive, a Kelly, a hoist and the like (not shown). Further, the tubular string 118 to be severed may be any suitable tubular and/or tubular string as described herein. The downhole tools 114 may be any suitable downhole tools for drilling, completing, evaluating and/or producing the wellbore 116, such as drill bits, packers, testing equipment, perforating guns, and the like. Other devices may optionally be positioned about the wellsite for performing various functions, such as a packer system 104 hosting the stripper 102 and a sleeve 130.

Figure 2:
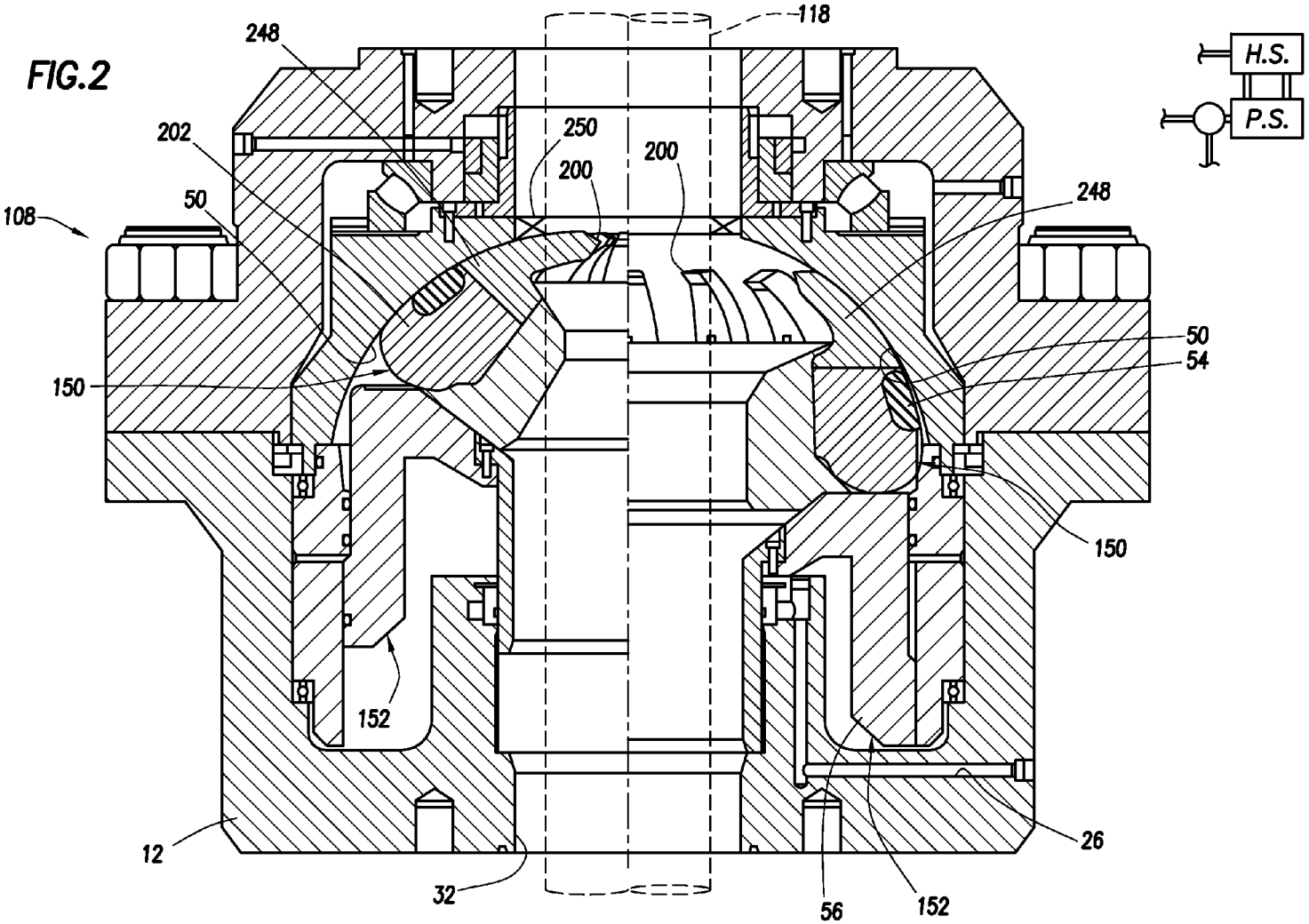
FIG. 2 is a cross-sectional view of the BOP of FIG. 1 taken along line 2-2.

FIG. 2 shows a cross-sectional view of the BOP 108 of FIG. 1 taken along line 2-2. The BOP 108 as shown has a housing 12 with the tubular severing system 150 and the actuators 152 therein. The tubular severing system 150 includes a plurality of cutting (or metal) elements 248 with elastomeric elements 52 and 54 therebetween. Elastomeric elements 52, 54 may be a single or multiple elements positioned between the cutting elements. The BOP 108 may be similar to the spherical BOPs 108 as described, for example in U.S. Pat. Nos. 5,588,491 and 5,662,171, previously incorporated by reference herein. The BOP 108 may be modified by providing the plurality of cutting tools 248 arranged radially around the BOP 108 as shown in FIG. 2. While the BOP 108 as shown is depicted in a dome configuration, it will be appreciated that the BOP 108 may be inverted such that the BOP 108 is in a bowl configuration. One or more tubular severing systems 150 may be positioned about the BOP 108.

The cutting tools 248 may be supported by the elastomeric elements 52, 54. The cutting tools 248 may also be supported in the housing 12 by a cutting tool carrier 202. The cutting tool carrier 202 may be constructed of a resilient material. The cutting tool carrier 202 may be any suitable member, bonnet, carriage and the like configured to be engaged by the actuator 152. The cutting tool carrier 202 may be a single member that radially surrounds the bore 32, or may be a plurality of members that hold the cutting tools 248 and surround the bore 32.

The cutting tools 248 may travel in a guideway (or curved outer surface) 50. The guideway 50 may direct each of the cutting tools 248 radially toward the tubular string 118 as the actuator 152 actuates the tubular severing system 150. The guideway 50 may be constructed of one or more bowl shaped inserts (or rotatable inner housings) 38 configured to guide the cutting tools 248. Although the bowl shaped inserts 38 are shown as a separate attachable piece, the bowl shaped inserts 38 may be integral with the BOP 108. The guideway 50 is shown as a bowl shape formed by the bowl shaped inserts 38, although the guideway 50 may take any suitable form, so long as the guideway 50 guides the plurality of cutting tools 248 into engagement with the tubular string 118 thereby severing the tubular string 118.

A seal 250 may seal the central bore 32. The cutting tool carrier 202 may be configured as the seal 250 to seal the central bore 32, and/or add flexibility to the travel paths of the cutting tools 248 as they travel in the guideway 50. If the cutting tool carrier 202 is configured to seal the central bore 32 upon severing the tubular string 118, the cutting tools 248, and/or portions thereof, may be configured to break off and/or move out of the way of the cutting tool carrier 202 as the cutting tool carrier moves into the central bore 32. The elastomeric seals 52, 54 may also be used to form a seal about the tubular string 118.

FIG. 2 also shows, for demonstrative purposes, a portion (left side) of the tubular severing system 150 in the BOP 108 in the actuated position, while another portion (right side) of the tubular severing system 150 is shown in the un-actuated position. In the un-actuated position, the actuator 152 is retracted, in this case toward a downhole end of the BOP 108. With the actuator 152 retracted, each of the cutting tools 248 is retracted out of a central bore 32 of the BOP 108, thereby allowing the tubular string 118 to move freely through the BOP 108.

When an event occurs requiring the severing of the tubular string 118, such as a pressure surge in the wellbore 116 (FIG. 1), an operator command, a controller command, etc., the actuator 152 actuates the cutting tools 248. To actuate the actuator 152, hydraulic fluid may be introduced into a piston chamber 90 via flow line 26. As the fluid pressure in the piston chamber 90 increases, a piston 56 may move toward the actuated position as shown on the left side of the BOP 108 in FIG. 2. The piston 56 has a piston head 57 for engaging the cutting tools 248 and advancing them to the actuated position. As shown, the actuators 152 are hydraulically operated and may be driven by a hydraulic system (not shown), although any suitable means for actuating the cutting tools 248 may be used such as pneumatic, electric, and the like.

Continued movement of the piston 56 moves each of the cutting tools 248 along the guideway 50. The cutting tool 248 follows the guideway 50 as a point (or tip or piercing point) 200 on each cutting tool 248 engages and then pierces the tubular string 118. Continued movement of the piston 56 severs the tubular string 118 completely as the cutting tools 248 converge toward a center axis z of the tubular string 118.

Figure 3:
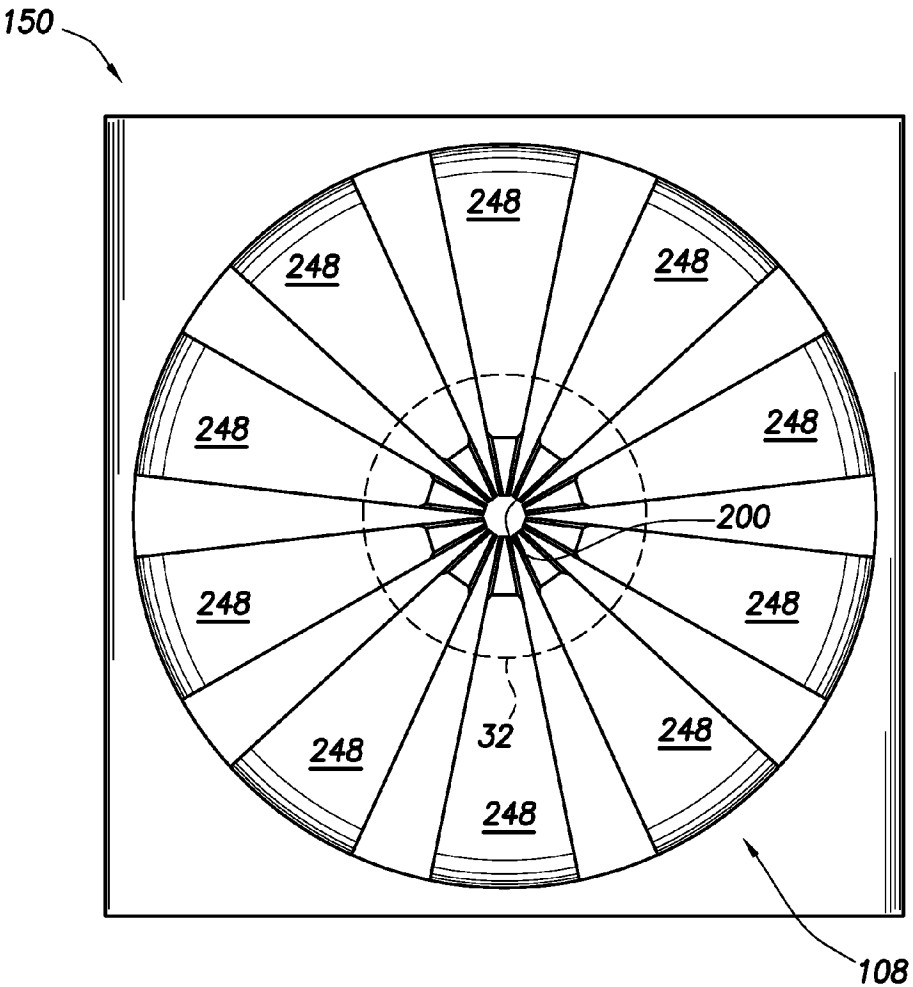
FIG. 3 is a schematic, top view of a portion of the BOP of FIG. 1 depicting the tubular severing system in a closed position.

FIG. 3 shows a schematic top view of the tubular severing system 150 in the BOP 108. The tubular severing system 150 may include a plurality of cutting tools 248 positioned radially about the central axis of the bore 32. In this figure, the cutting tools 248 are depicted in the fully actuated position whereby the cutting tools 248 are converged to the central axis of the bore 32 of the BOP 108. As depicted in this figure, the cutting tools 248 may converge at a central or off-center location within the bore 32 for engagement with the tubular 118.

Figure 4A:
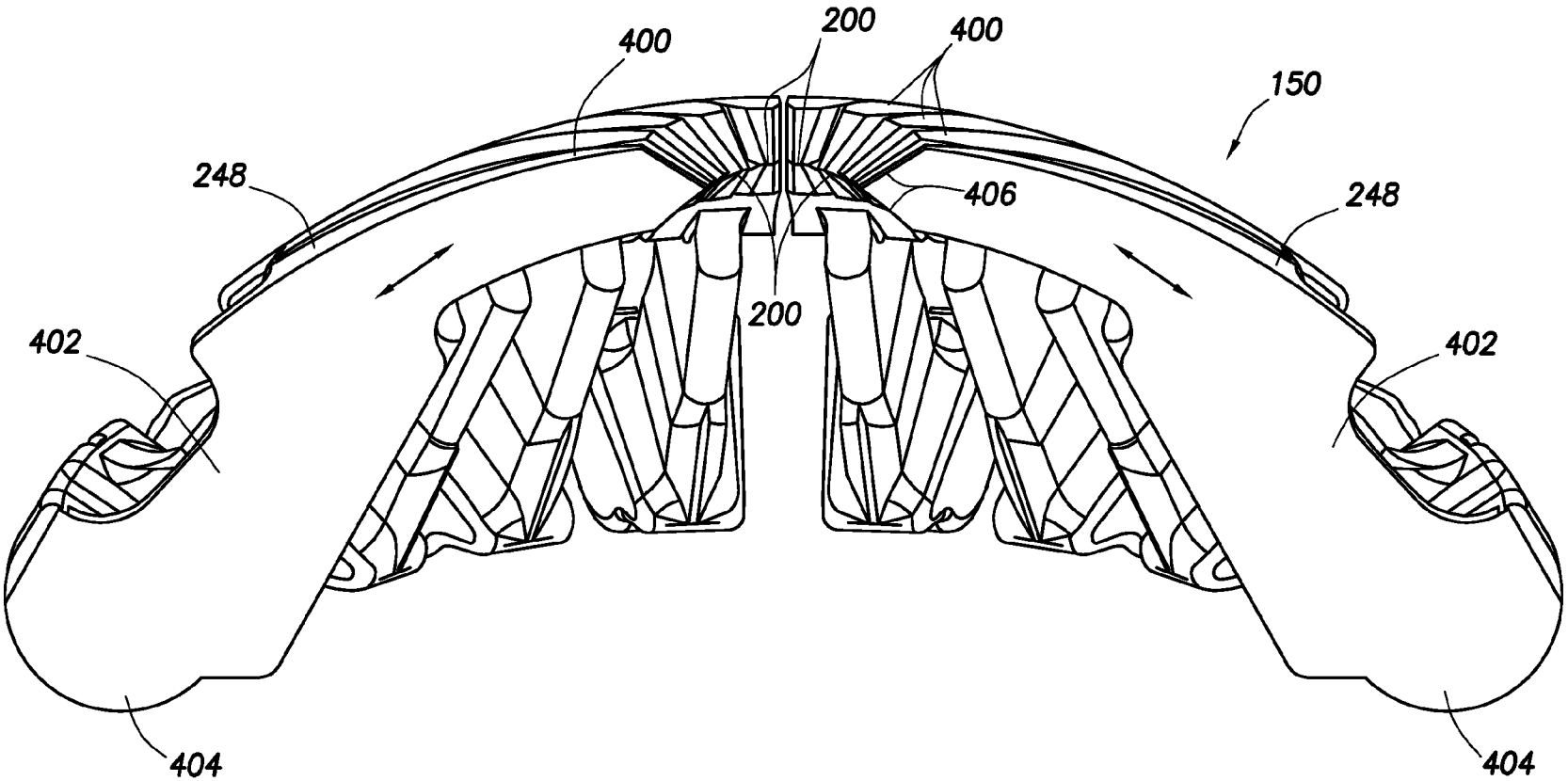
FIGS. 4A and 4B are schematic views of a portion of the tubular severing system of FIG. 1 in an actuated position.
Figure 4B:
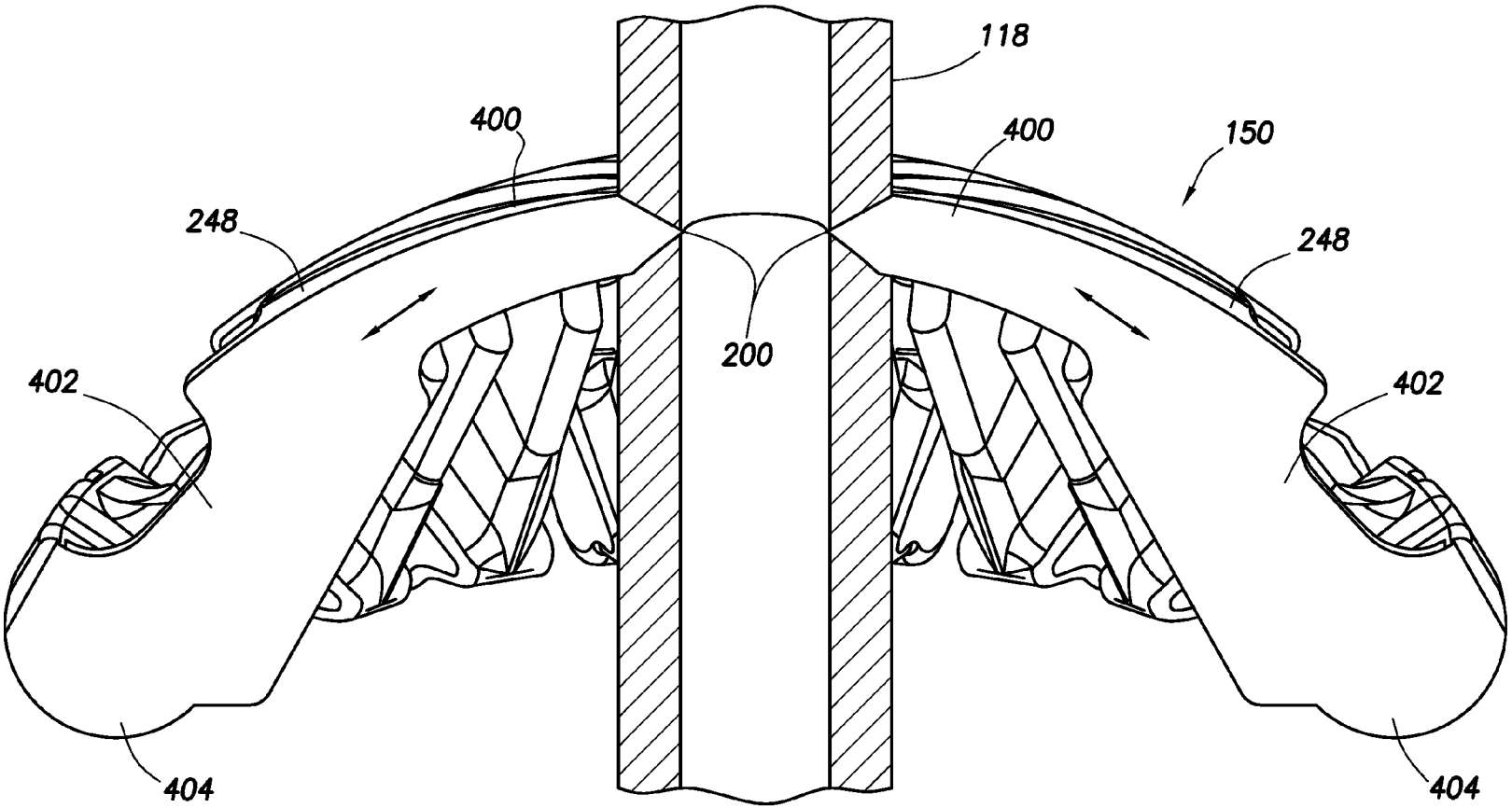

FIGS. 4A and 4B show a portion of the tubular cutting system 150 in greater detail with the rubber elements removed. As shown in these figures, the tubular cutting system 150 includes the cutting tools 248 positioned adjacent to each other in a dome-shaped configuration. The cutting tools 248 may be positioned in a tight or loose configuration radially about the tubular. The cutting tools 248 may be arranged so that, upon activation, the cutting tools 248 converge about the tubular 118.

Each of the cutting tools 248 has a cutting head 400, a body 402 and a base 404. The cutting head has a tip at an end thereof. The tip has a piercing point 200 for piercing the tubular 118, and angled cutting surfaces 406 extending from the piercing point 200. The angled cutting surfaces 406 taper away from the piercing point 200 and toward the body 402.

FIG. 4A shows the portion of the tubular cutting system 150 without the BOP 108 and/or the tubular 118 (as shown in FIG. 1). This view shows the plurality of cutting tools 248 in greater detail in the actuated position. As shown, the cutting heads 400 have converged together where the central bore 32 (as shown in FIG. 2) would have been. The cutting tools 248 are positioned so that, upon activation, the points 200 of each of the cutting heads 400 converge.

FIG. 4B shows the plurality of cutting tools 248 in the actuated position with a tubular 118 therein as it is severed by the cutting tools 248. The piercing point 200 of each of the cutting heads 400 has pierced a hole into the tubular. The cutting heads 400 form a plurality of holes in a ring around the tubular 118. The cutting surfaces 406 of each of the cutting heads 400 advance through the pierced holes to expand the holes until the tubular 118 is severed.

Figure 5A:
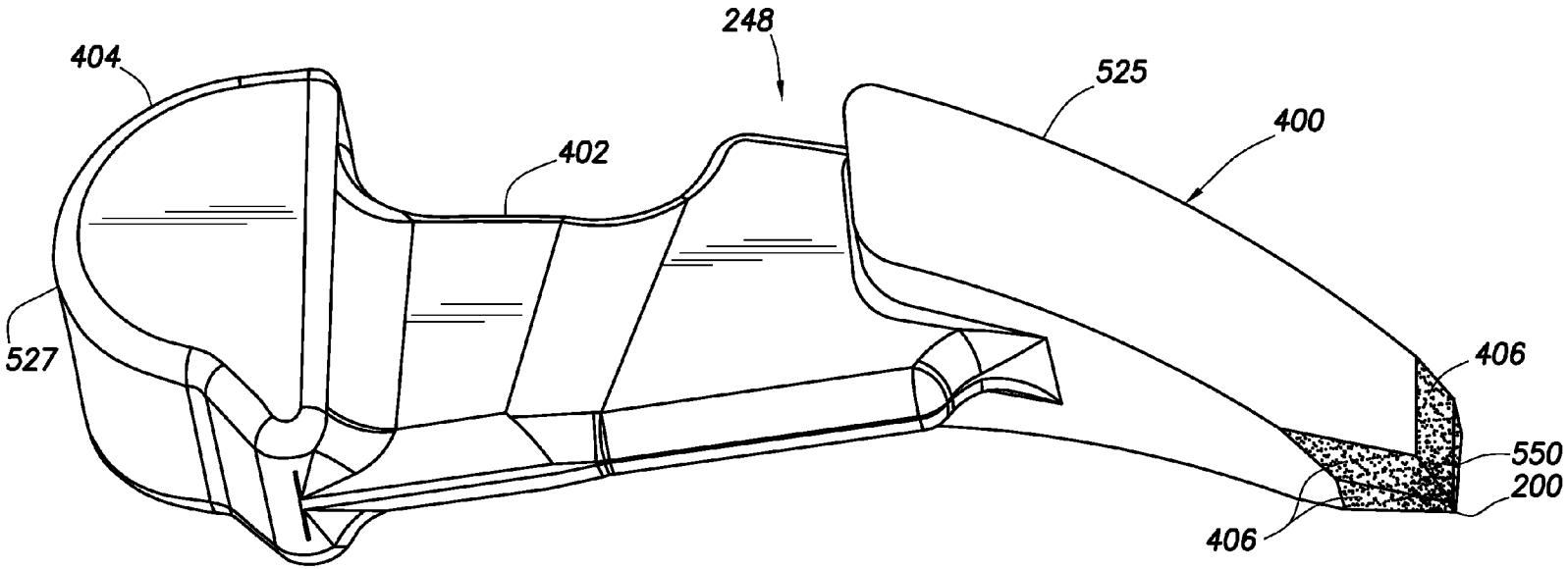
FIGS. 5A and 5B are various perspective views of a cutting tool of the tubular severing system of FIG. 1.
Figure 5B:
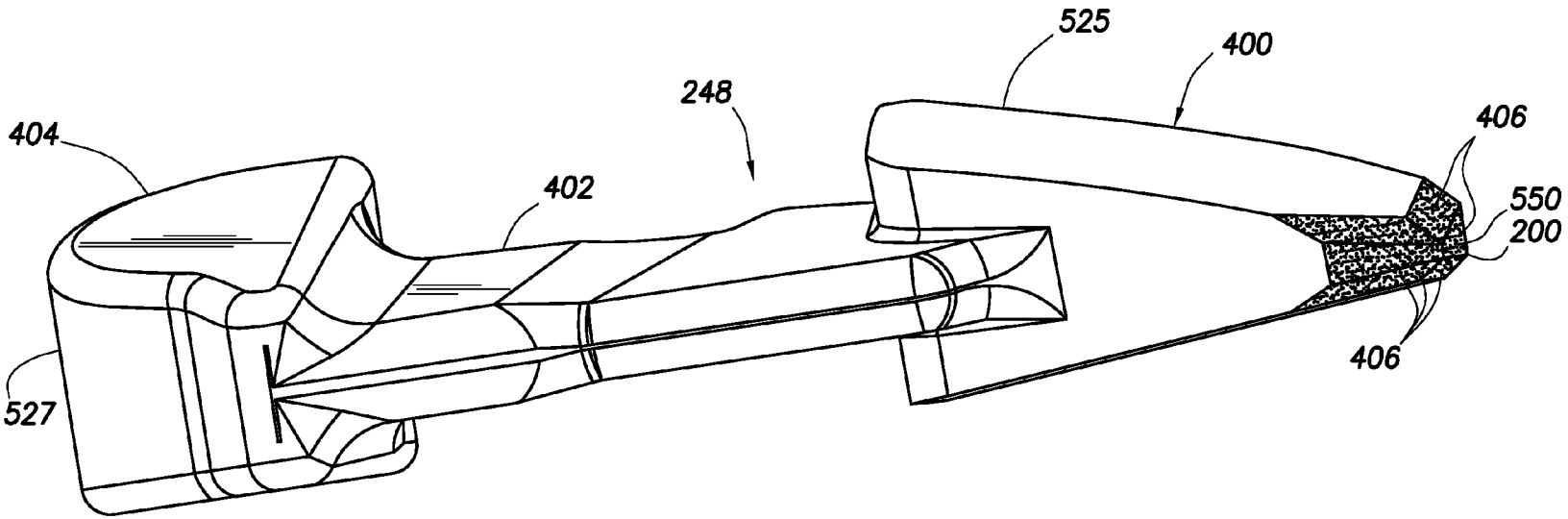

The cutting tools 248 may have any form suitable for traveling in the guideway 50 and severing the tubular string 118. FIGS. 5A and 5B show one of the cutting tools 248 in greater detail. FIGS. 5A and 5B shows perspective side and bottom views of the cutting tool 248. The cutting tool 248, as shown, has the cutting head 400, the body 402 and the base 404. The cutting head 400 may have the point 200, one or more cutting surfaces 406 and a guide surface 525. The point 200 may be configured to be the first point of contact for the cutting tool 248 and the tubular string 118.

The point 200 may have any structure suitable for puncturing, cutting, shearing and/or rupturing the tubular string 118. For example, the point 200 may be a cone, a blade, a pick type surface and the like. As shown in FIGS. 5A and 5B, the point 200 is a wedge shaped blade. The point 200 may have a leading edge or terminate at a point. The tip 401 as shown in FIGS. 5A and 5B has multiple, flat cutting surfaces 406 extending from the point 200. The cutting surfaces 406 may cut, shear, sever and/or destroy the wall of the tubular string 118 as the cutting tool 248 continues to move into the tubular string 118. Further, the cutting surfaces 406 may act as a wedge to spread the wall of the tubular string 118 apart as the cutting tool 248 cuts. The cutting surfaces 406 taper away from the point 200 at a leading end of the cutting tool 248. The cutting surfaces 406 are depicted as flat, polygonal surfaces that extend at an angle away from the piercing point 200. The angles and shapes of the cutting surfaces 406 and/or piercing point 200 may be selected to facilitate entry into the tubular, expansion of the holes formed by the piercing points 200 and/or severing of the tubular 118.

The guide surface 525 of the cutting tool 248 may be configured to guide the cutting tool 248 along the guideway 50 as the actuator 152 motivates the cutting tool 248 toward the tubular string 118 (as shown in FIG. 2). The guide surface 525 of the cutting tool 248 may conform to the shape of the guide 50 for slidable movement therealong. The guide surface 525 may terminate at one end at the cutting surfaces 406, and at an opposite end at the body 402.

The base 404 may be configured to couple the cutting tool 248 to the cutting tool carrier 202 and/or actuator 152 (as shown in FIG. 2). As the cutting tool carrier 202 is engaged by the actuator 152, the cutting tool carrier 202 moves the base 404 and thereby the cutting tool 248. The base 404 may also have an actuation surface 527 for actuatable engagement with the actuator 152. The base 404 may be any suitable shape for securing to and/or engaging the cutting tool carrier 202 and/or actuator 152.

The body 402 may be configured to be a support between the base 404 and the cutting head 400. The body 402 may be any suitable shape for supporting the cutting head 400. Further, the body 402 may be absent and the cutting head 400 may extend to the base 404 and/or form the base 404. The body 402 may have a narrower width than the base 404 and the cutting head 400 for placement and flow of the elastomeric elements 52 and 54 between adjacent cutting tools 248.

The cutting tools 248, and/or portions thereof, may be constructed of any suitable material for cutting the tubular string 118, such as steel. Further, the cutting tools 248 may have portions, such as the points 200, the cutting head 400, and/or the cutting surfaces 406, provided with a hardened material 550 (as shown in FIG. 5A) and/or coated in order to prevent wear of the cutting tools 248. This hardening and/or coating may be achieved by any suitable method such as, hard facing, heat treating, hardening, changing the material, and/or inserting hardened material such as polydiamond carbonate, INCONEL™ and the like.

Figure 6A:
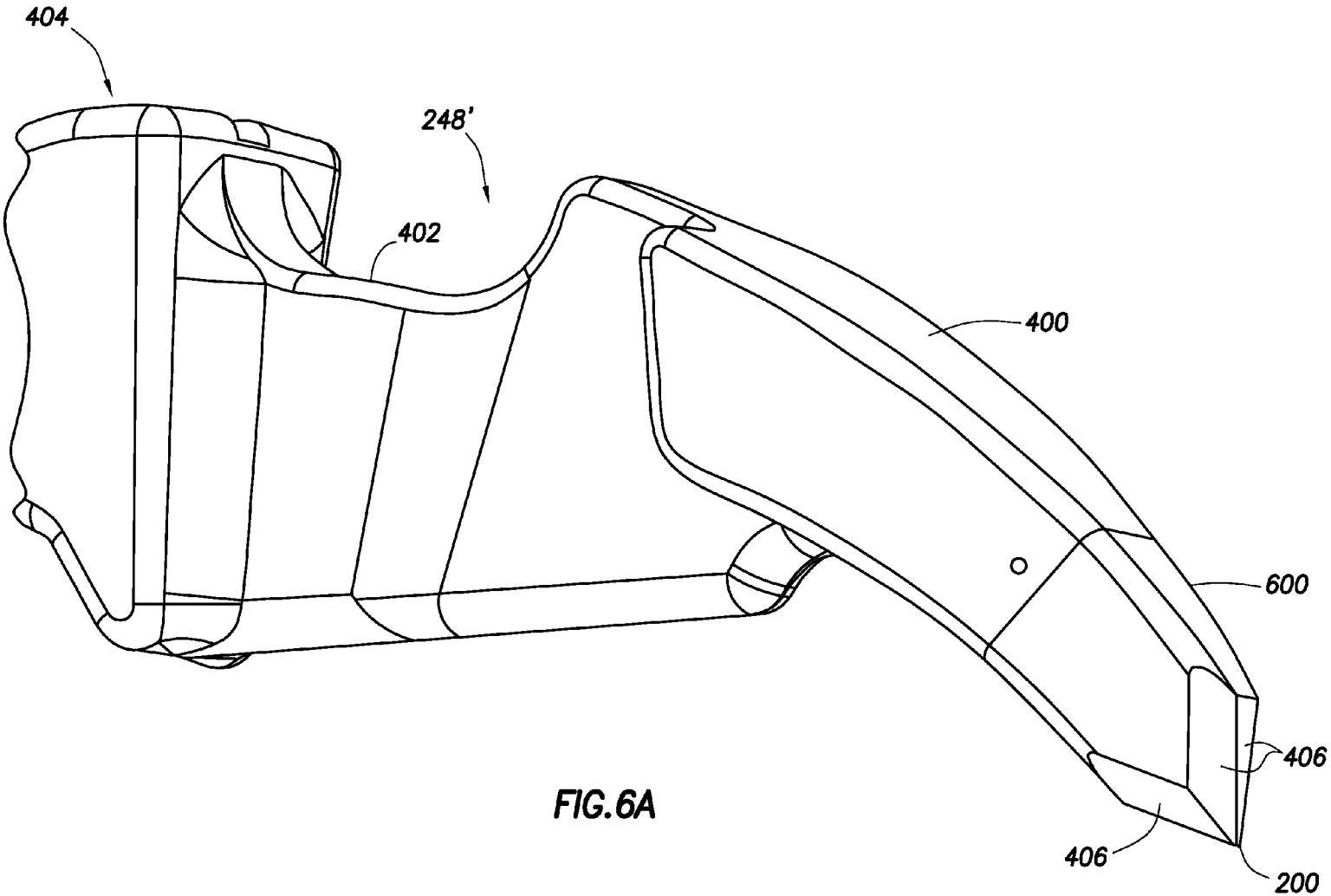
FIGS. 6A-6C are various perspective views of a cutting tool of the tubular severing system of FIG. 1 having a replaceable tip.
Figure 6B:
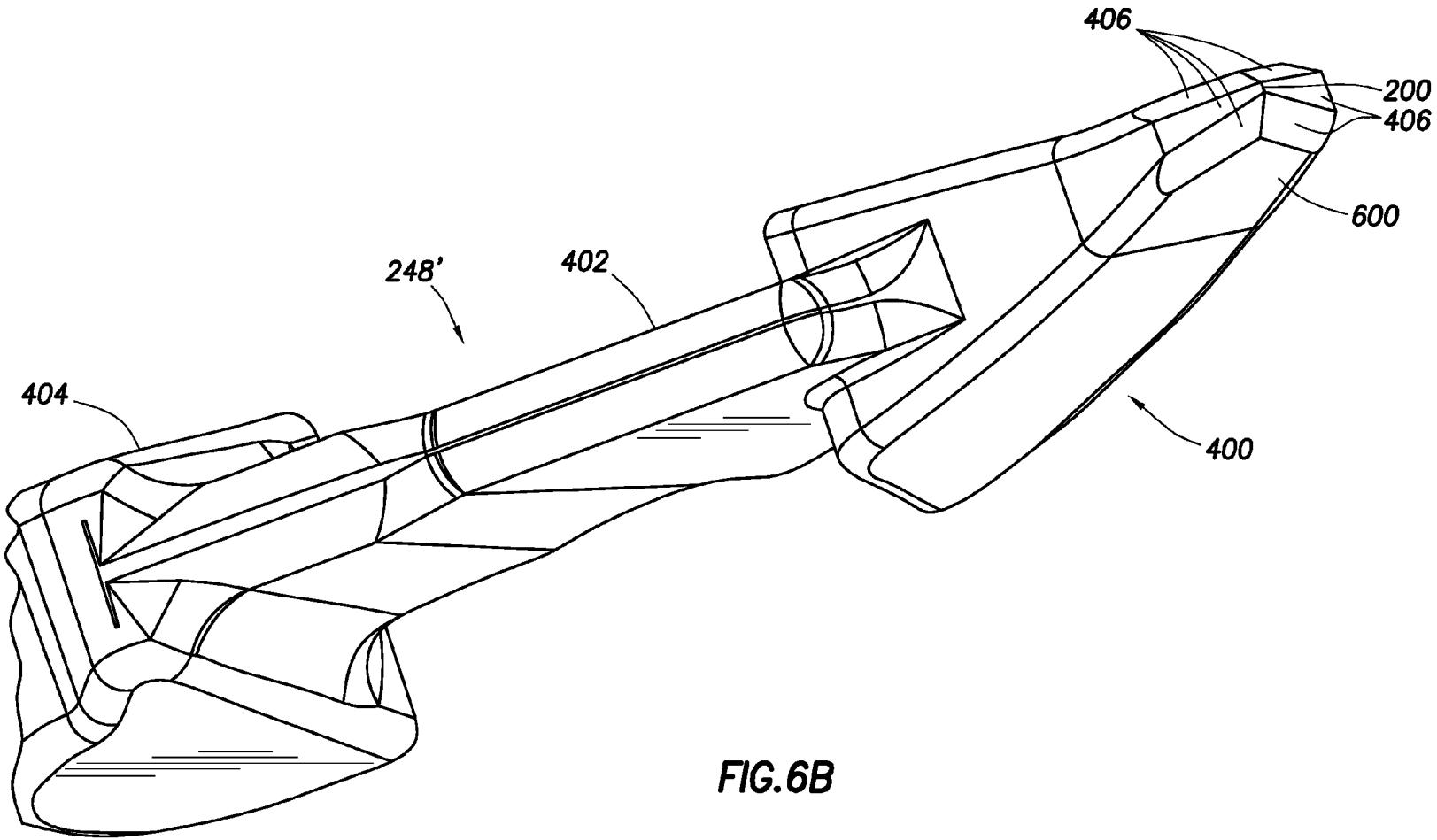
Figure 6C:
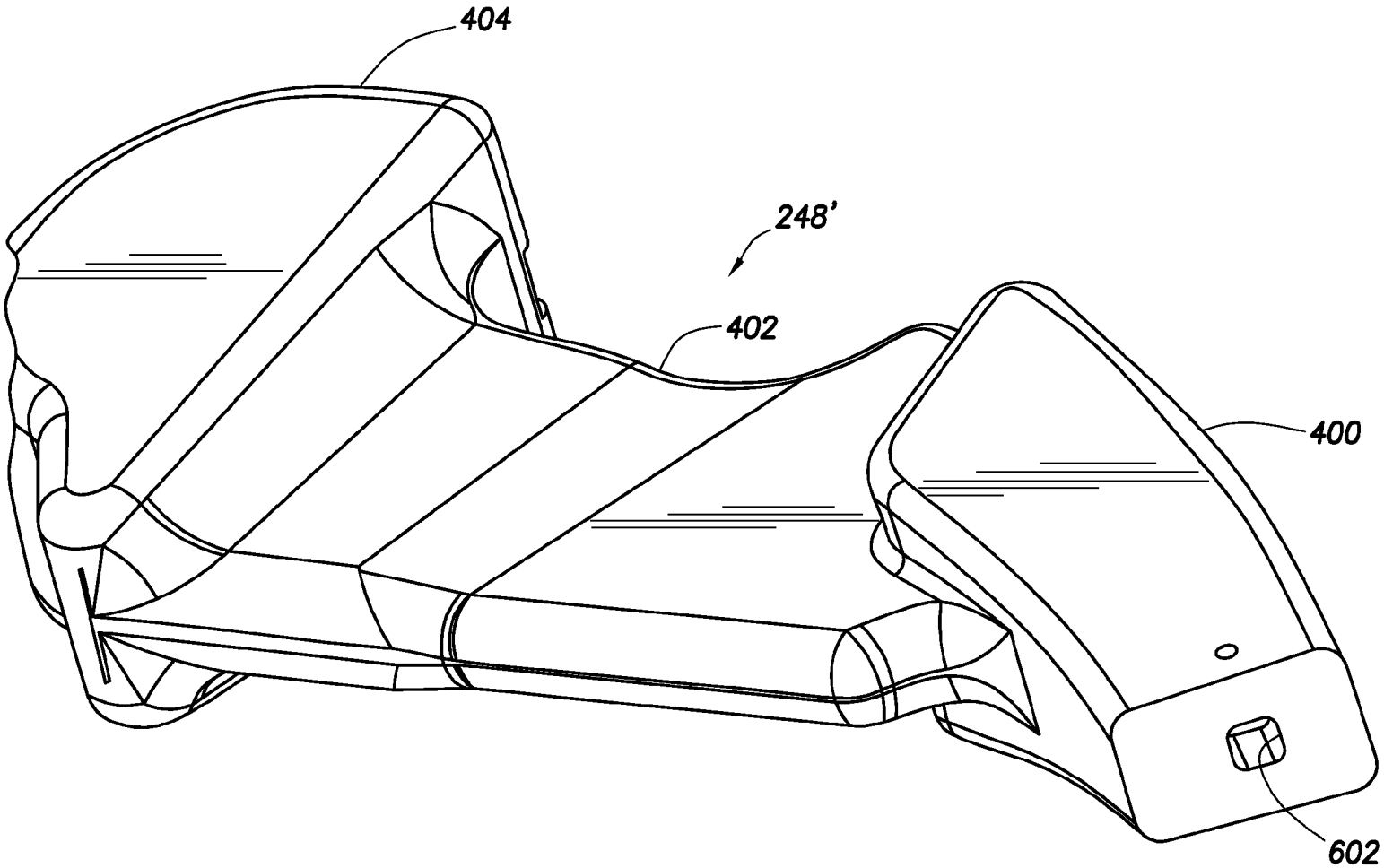

FIGS. 6A-6C show perspective views of a cutting tool 248' usable as the cutting tool 248, and having a replaceable tip 600. The cutting tool 248' of these figures may be the same as the cutting tool 248' previously described, except that a portion of the cutting head 400 comprises the replaceable tip 600. The replaceable tips 600 may be shaped like any of the tips 401 described herein. The replaceable tips 600 may be constructed with the same material as the cutting tool 248 and/or any of the hardening and/or coating materials and/or methods described herein.

Figure 7:
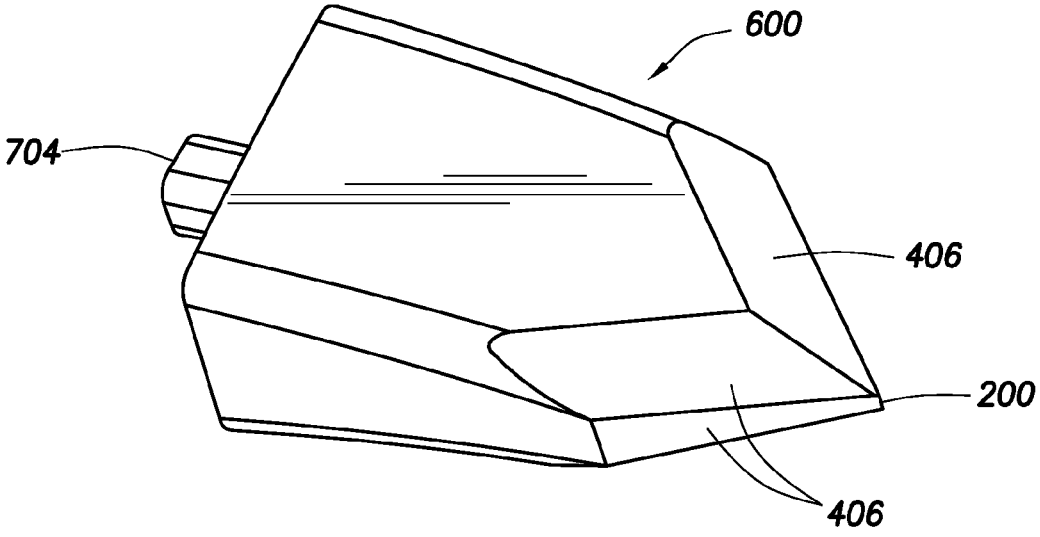
FIG. 7 is a perspective view of the replaceable tip of FIG. 6A.

The replaceable tips 600 and cutting head 400 may be connectable by any means. The replaceable tips 600 and/or the cutting head 400, the body 402, or the base 404 may have one or more connector holes 602, as shown in FIG. 6C for receivably coupling with the replaceable tips 600 to the cutting tool 248'. The connector holes 602 may be configured to receive a connector 704 on the replaceable tip 600 as shown in FIG. 7. The replaceable tips 600 may allow the operator to easily replace the tips during maintenance. Further, the replaceable tips 600 may be configured to easily break off in order to allow the cutting tool carrier 202 (as shown in FIG. 2) to seal the bores 32. Such 'frangible' tips 600 may be made of material that is sufficient to puncture and/or cut the tubular, but breaks away from the tubular severing system 150.

Figure 8:
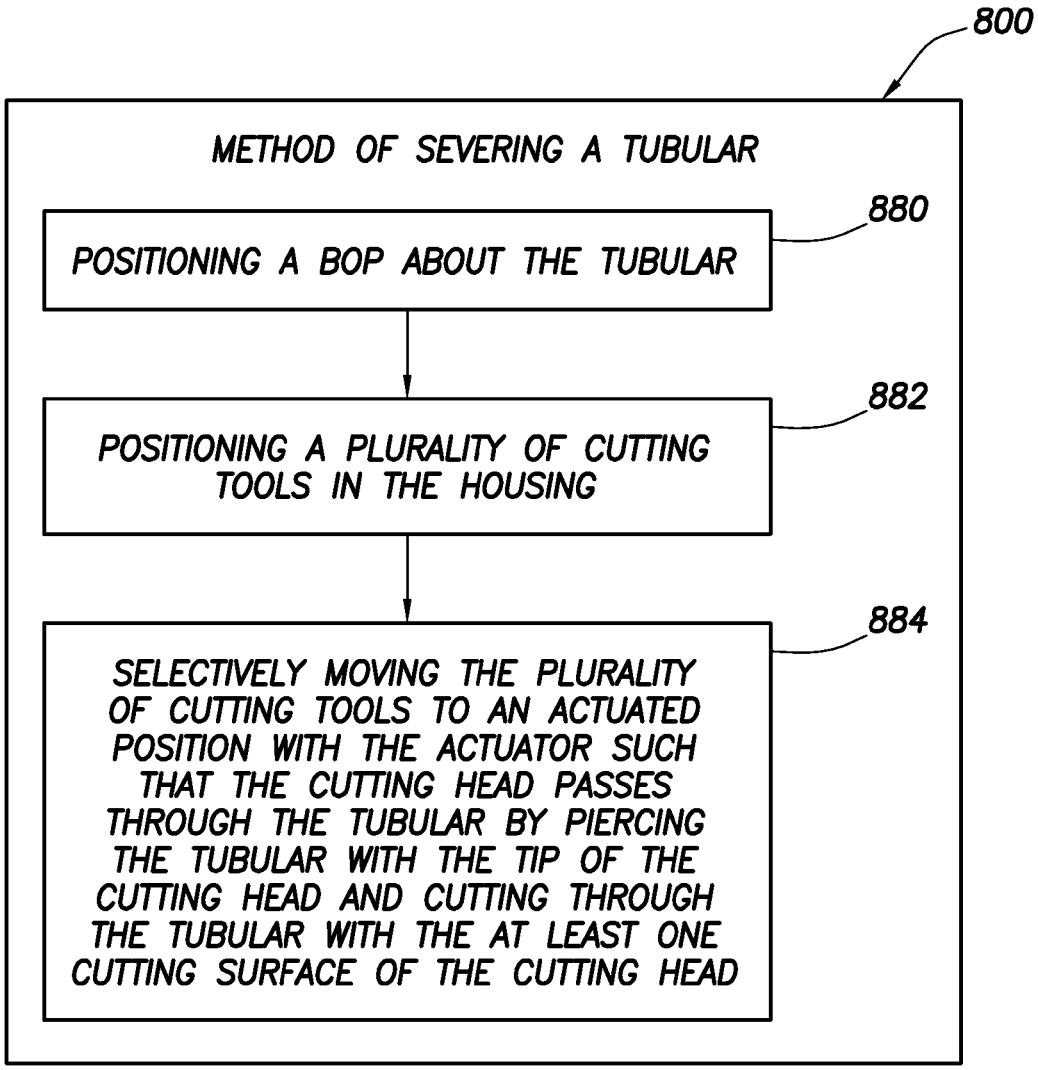
FIG. 8 is a flow chart depicting a method of severing a tubular.

FIG. 8 depicts a method 800 of severing a tubular. The method involves positioning (880) a BOP about the tubular, positioning (882) a plurality of cutting tools in the housing, and selectively (884) moving the plurality of cutting tools to an actuated position with the actuator such that the cutting head passes through the tubular by piercing the tubular with the tip of the cutting head and cutting through the tubular with the cutting surface of the cutting head.

The method may also involve guiding the plurality of cutting tools along a guide of the housing, sealing a bore of the housing with a seal, breaking off a portion of the cutting head, and/or replacing a portion of the cutting head. The steps may be performed in any order, and repeated as desired.

In operation, the severing action of tubular severing system 150 may pierce, shear, and/or cut the tubular string 118 (see, e.g., FIG. 2). After the tubular string 118 is severed, a lower portion of the tubular string 118 may drop into the wellbore 116 (not shown) below the blowout preventer 108. Optionally (as is true for any method according to the present invention) the tubular string 118 may be hung off the BOP after being severed. The BOP 108, the cutting tool carrier 202, seal 250, elastomeric members 52, 54, and/or another piece of equipment may then seal the bore hole 32 in order to prevent an oil leak, and/or explosion. The sealing using a spherical BOP is described, for example, in U.S. Pat. Nos. 5,588,491 and 5,662,171, previously incorporated by reference herein.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, any number of the cutting tools at various positions may be moved into engagement with the tubular at various times.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A cutting tool for severing a tubular of a wellbore, the cutting tool positionable in a housing and actuatable by an actuator of a blowout preventer, the blowout preventer having a bore therethrough for receiving the tubular, the cutting tool comprising:

a base supportable by the actuator and selectively movable thereby; and a cutting head supported by the base, the cutting head having a curved outer guide surface and comprising a tip having a piercing point at an end thereof and at least one cutting surface, the piercing point for piercing the tubular, the at least one cutting surface tapering away from the piercing point for cutting through the tubular whereby the cutting head passes through the tubular.

2. The cutting tool of claim 1, wherein the tip is removeable.

3. The cutting tool of claim 2, wherein the tip has a connector receivable by a hole in the cutting head.

4. The cutting tool of claim 2, wherein the tip is frangible.

5. The cutting tool of claim 1, wherein the tip terminates at a leading edge.

6. The cutting tool of claim 1, wherein the tip terminates at a point.

7. The cutting tool of claim 1, wherein the at least one cutting surface comprises a plurality of flat surfaces, each of the plurality of flat surfaces extending at an angle from the tip.

8. The cutting tool of claim 1, further comprising a hardening material.

9. The cutting tool of claim 1, wherein the cutting head has a guide surface for slidably engaging a guide of the housing.

10. The cutting, tool of claim 1, further comprising a body between the base and the cutting head.

11. A blowout preventer for severing a tubular of a wellbore the blowout preventer comprising:

a housing having a bore therethrough for receiving the tubular;

an actuator positionable in the housing; and a plurality of cutting tools positionable in the housing and selectively movable into an actuated position with the actuator, each of the plurality of cutting tools comprising:

a base supportable by the actuator and selectively movable thereby; and a cutting head supported by the base, the cutting head having a curved outer guide surface and comprising a tip having a piercing point at an end thereof and at least one cutting surface, the piercing point for piercing the tubular, the at least one cutting surface tapering away from the piercing point for cutting through the tubular whereby the cutting head passes through the tubular.

12. The blowout preventer of claim 11, wherein the housing has an insert therein defining a guide, the cutting head having a guide surface for slidably engaging the guide.

13. The blowout preventer of claim 11, wherein the actuator comprises a piston having a piston head for engaging an actuation surface of the base.

14. The blowout preventer of claim 11, further comprising at least one elastomeric element positionable between the plurality of cutting tools.

15. The blowout preventer of claim 11, further comprising a cutting tool carrier for supporting the plurality of cutting tools.

16. The blowout preventer of claim 11, further comprising a seal for sealing the bore.

17. The blowout preventer of claim 11, wherein the plurality of cutting tools are arranged in a dome-shaped configuration with the tips of each of the plurality of cutting tools converging about the tubular.

18. The blowout preventer of claim 11, wherein the plurality of cutting tools are arranged in an inverted dome-shaped configuration with the tips of each of the plurality of cutting tools converging about the tubular.

19. A method of severing a tubular of a: wellbore, the method comprising:

positioning a BOP about the tubular, the BOP comprising a housing and an actuator;

positioning a plurality of cutting tools in the housing, each cutting tool comprising:

a base supportable by the actuator and selectively movable thereby;

a cutting head supported by the base, the cutting head having a curved outer guide surface and comprising a tip having a piercing point at an end thereof and at least one cutting surface that tapers away from the piercing point; selectively moving the plurality of cutting tools to an actuated position with the actuator such that the cutting head passes through the tubular by piercing the tubular with the piercing point and cutting through the tubular with the at least one cutting surface; and advancing the plurality of cutting tools through the tubular.

20. The method of claim 19, further comprising guiding the plurality of cutting tools along a guide of the housing.

21. The method of claim 19, further comprising sealing a bore of the housing with a seal.

22. The method of claim 19, further comprising breaking off a portion 'of the cutting head.

23. The method of claim 19, further comprising replacing a portion of the cutting head.

24. The method' of claim 19, further comprising selectively retracting the plurality of cutting tools.

25. The method claim 19, further comprising securing the plurality of cutting tools with the housing.

26. The cutting tool of claim 1, wherein the tubular is a tool joint.

27. The blowout preventer of claim 11, wherein the tubular is a tool joint.

28. The method of claim 19, wherein the tubular is a tool joint.

* * * * *